US006564387B1

(12) United States Patent
Willoughby

(10) Patent No.: US 6,564,387 B1
(45) Date of Patent: May 20, 2003

(54) VEST OR JACKET EQUIPPED WITH INFLATABLE CONVERTIBLE SEAT CUSHION AND LOWER BACK CUSHION

(76) Inventor: Jo Ann Leigh Willoughby, Box 146, 4512 Wallbridge Road, Armstrong, British Columbia (CA), V0E 1B0

( * ) Notice: Subject to any disclaimer, the term of this patent is extended or adjusted under 35 U.S.C. 154(b) by 0 days.

(21) Appl. No.: 09/695,074

(22) Filed: Oct. 25, 2000

Related U.S. Application Data

(60) Provisional application No. 60/161,068, filed on Oct. 25, 1999.

(51) Int. Cl.[7] ..... A41D 13/00

(52) U.S. Cl. ..... 2/69; 2/DIG. 3; 297/4; 297/180.11

(58) Field of Search ..... 2/455, 456, 465, 2/467, 44, 46, 48, 50–51, 69, 69.5, 79, 85, 88, 92, 94, 102, 108, 115, 227, DIG. 3; 297/4, 180.11, 284.5, DIG. 3

(56) References Cited

U.S. PATENT DOCUMENTS

| | | | | | |
|---|---|---|---|---|---|
| 1,468,072 | A | | 9/1923 | Ogle | |
| 1,626,166 | A | * | 4/1927 | Stair | 2/94 |
| 2,061,355 | A | | 11/1936 | Foreman | |
| 3,185,362 | A | * | 5/1965 | Wakefield | 2/24 |
| 3,665,517 | A | | 5/1972 | Hyman | |
| 4,370,755 | A | | 2/1983 | Crumby | |
| 4,718,375 | A | | 1/1988 | Krieger | |
| 4,737,994 | A | | 4/1988 | Galton | |
| 5,085,514 | A | | 2/1992 | Ross | |
| 5,271,659 | A | * | 12/1993 | Zinkevicz | 297/284.6 |
| 5,303,425 | A | | 4/1994 | Mele | |
| 5,727,260 | A | | 3/1998 | Torch et al. | |

FOREIGN PATENT DOCUMENTS

| | | |
|---|---|---|
| CA | 2061355 | 3/1997 |

* cited by examiner

*Primary Examiner*—John J. Calvert
*Assistant Examiner*—Tejash Patel
(74) *Attorney, Agent, or Firm*—Antony C. Edwards

(57) ABSTRACT

The inflatable clothing of the present invention includes a garment having a manually inflatable air capsule. The air capsule may be pivotally mounted to the back panel of the garment so that the air capsule may be pivoted between a raised position, wherein the capsule may be releasably secured by a fastener so as to remain in the raised position, and a lowered position disposed adjacent the buttocks of a user wearing the garment.

5 Claims, 8 Drawing Sheets

Fig. 5
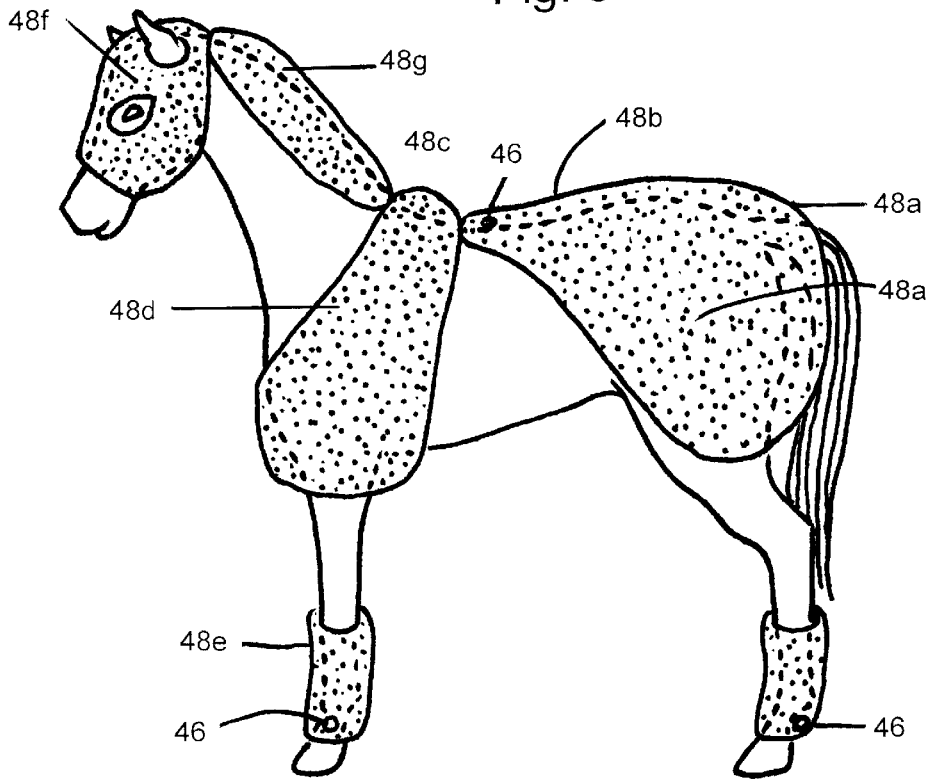
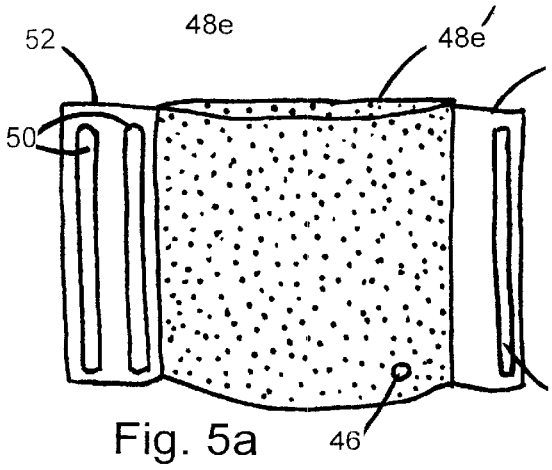
Fig. 5a
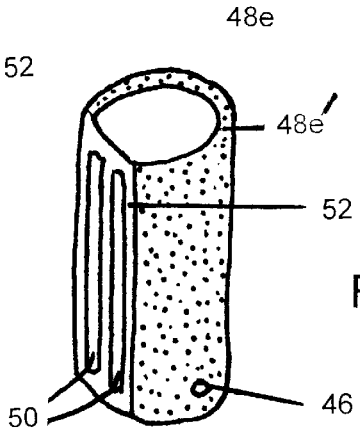
Fig. 5b

VEST OR JACKET EQUIPPED WITH INFLATABLE CONVERTIBLE SEAT CUSHION AND LOWER BACK CUSHION

CROSS REFERENCE TO RELATED APPLICATION

This application claims priority from U.S. Provisional Patent Application No. 60/161,068 filed Oct. 25, 1999 entitled Vest or Jacket Equipped With Inflatable Convertible Seat Cushion And Lower Back Cushion.

FIELD OF THE INVENTION

This invention relates to the incorporation of inflatable cushions, or capsules into clothing to provide comfort for the user.

BACKGROUND OF THE INVENTION

The prior art reveals several types of devices employing the shock absorbing properties of inflatables for preventing injury during high speed and high impact sports. Some of these rely upon the use of $CO_2$ cartridges that can only be used once and then need to be replaced. These types of protective clothing tend to be bulky, complicated, unattractive, physically inhibiting and expensive to produce. The prior art designs are mainly specific to a particular sport and are not intended for use by the general public. Also shown is a cooling mechanism with tubing encircling the body and connecting a plurality of small inflatable pads that lift the shirt away from the skin to facilitate air venting through flaps. The small inflatable pads do not perform the function of a seat or back cushion and the device is intended to be used for cooling the user, whereas the present invention provides insulation, cushioning, support, shock absorption and waterproofing, or at least water-inhibiting. Therapeutic inflatable appliances attached to undergarments and hospital gowns are shown, utilizing the cushioning properties in the prevention of fractures, bruising and to alleviate pain from haemorrhoids. These inventions are mainly designed for the elderly and infirm, or address specific medical challenges. The clothing is clearly not designed to be worn to enjoy recreational activities or for use in inclement weather or conditions generally, as in one aspect of present invention.

In particular, applicant is aware of the following patents: U.S. Pat. No. 3,077,324; U.S. Pat. No. 5,303,425; U.S. Pat. No. 3,995,320; U.S. Pat. No. 4,213,202; U.S. Pat. No. 4,870,706; U.S. Pat. No. 5,403,123; U.S. Pat. No. 4,067,063; U.S. Pat. No. 4,168,063; U.S. Pat. No. 4,310,927 and U.S. Pat. No. 4,089,085.

SUMMARY OF THE INVENTION

Inflatable air capsules may be designed into various types of clothing to cushion a part of the body. The inflatable capsules may be comprised of any durable, impermeable fabric such as vinyl, PVC, plastic or rubberised canvas, sealed at the seams by means of high frequency welding, heat bonding, stitching and adhesives, or any method that will render them airtight.

The capsules are fitted with a valve or device capable of providing air to the capsule and releasing it when desired. This may be accomplished by the use of push-in valves, utilising the user's own breath, Boston valves, one way valves, $CO_2$ cartridge mechanism, self-inflating valves, or by any other type of inflation valve or device suitable for the clothing and circumstance.

To facilitate convenient inflation by mouth, flexible tubing may be incorporated into a garment, running from an inflatable capsule to the vicinity of the user's mouth. A valve plug may be attached to the end of the tubing. To deflate or reduce air pressure, the user pulls the plug out of the tubing. The end of the tubing may be stored, for example, coiled in a pocket, when not in use.

Flexible tubing may also be used as an extension device to inflate air capsules remotely. The correct diameter of tubing is inserted snugly into the corresponding push-in valve to facilitate convenient inflation of the capsule.

The capsules may be designed to be sewn into the garments or attached by means of adhesives, Velcro, zippers, snaps or any other suitable fastener.

The air capsules may be designed to be worn on either the inside or the outside of a garment, or both.

Inflatable air capsules may be incorporated into equine clothing.

Inflatable air capsules can be made with very durable fabrics when required.

In summary, the inflatable clothing of the present invention includes a garment having a manually inflatable air capsule. The air capsule may be pivotally mounted to the back panel of the garment so that the air capsule may be pivoted between a raised position, wherein the capsule may be releasably secured by a fastener so as to remain in the raised position, and a lowered position disposed adjacent the buttocks of a user wearing the garment.

The air capsule may be shaped so as to cover at least the user's buttocks, for example the buttocks and thighs, in the lowered position and may be pivotally mounted to the back panel along an upper edge of the capsule. When so mounted the upper edge of the capsule may be adjacent the small of the user's back when the garment is worn by the user.

In one embodiment garment is worn by the user about at least the torso and midriff of the user. For example, the garment may be a jacket or a vest.

In one embodiment the capsule is mounted to the back panel by a stitched seam extending at least partially laterally across the back panel and the upper edge of the capsule. The capsule may be a generally rectangular flexible bladder although this is not intended to be limiting as it is understood that other shapes of bladder may be tailored to cover the desired body part.

The fastener may be a hook and loop fastener mounted to the back of the garment, for example, on an interior surface therein.

The flexible bladder may include a valve having an inlet aperture so that a flexible tube is mountable to the valve so as to cooperate therewith for inflation of the bladder. The tube may be of sufficient length so as to extend from the valve to both the mouth of the user and a pocket of the garment for storage of the tube therein. The tube may include a plug for removably plugging a distal end of the tube, that is the end distal from an opposite end mountable to the valve. The plug is for remotely sealing the valve upon inflation of the bladder and for remotely deflating the bladder upon removal of the plug from the distal end of the tube.

BRIEF DESCRIPTION OF THE DRAWINGS

FIG. 5 is, in side elevation view, a further alternative embodiment of the inflatable clothing of the present invention.

FIG. 5*a* is, in plan view, the leg capsule of FIG. 5 removed from the leg and laid flat.

FIG. 5*b* is, in perspective view, the leg air capsule of FIG. 5*a* as it would be wrapped around the leg of FIG. 5.

DETAILED DESCRIPTION OF PREFERRED EMBODIMENTS

Figure 1:
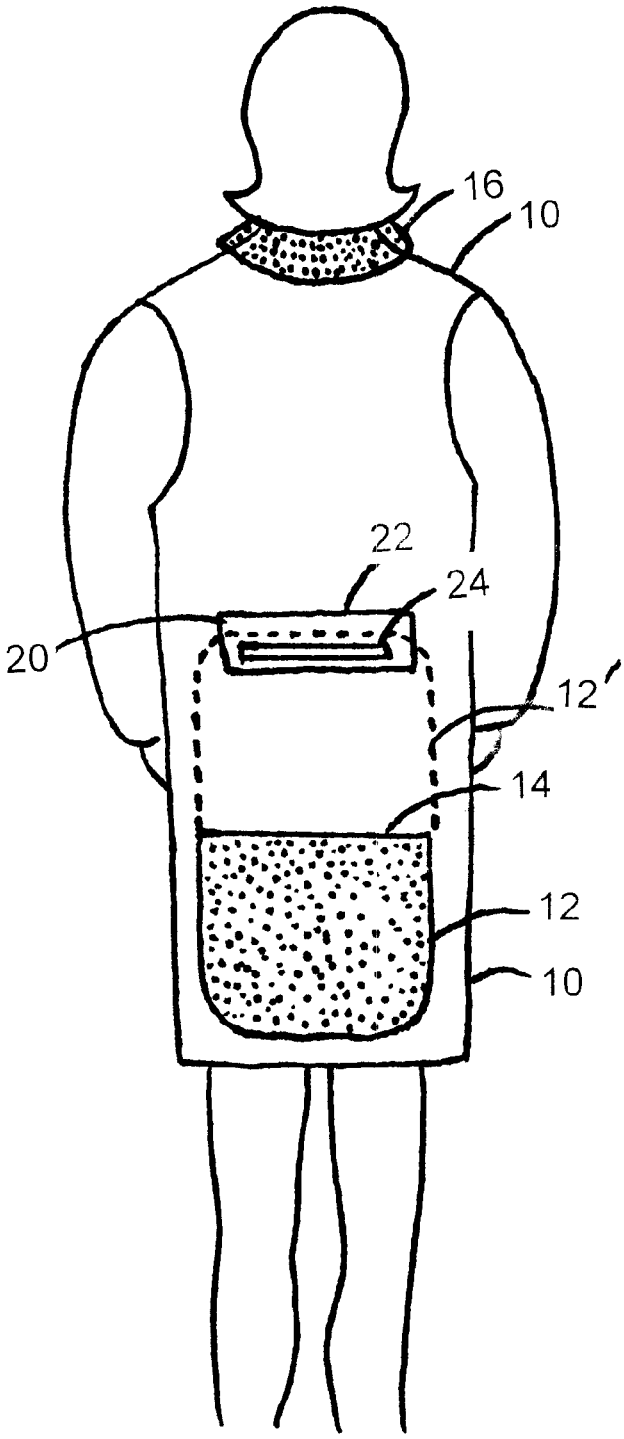
FIG. 1 is, in rear elevation view, a user wearing an article of inflatable clothing of the present invention.
Figure 1A:
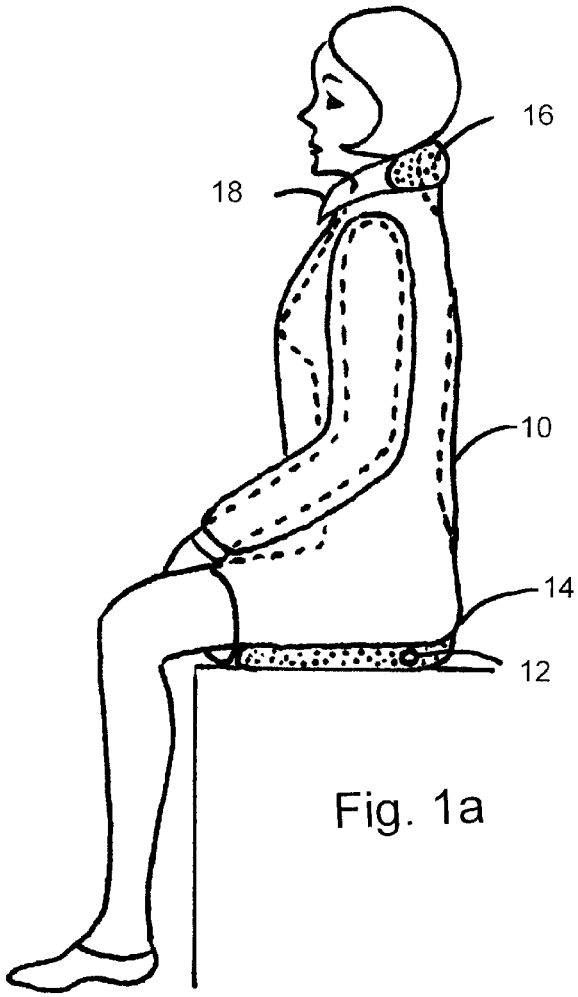
FIG. 1*a* is, in side elevation view, a user wearing the inflatable clothing of FIG. 1 with the air capsule in its lowered position.
Figure 1B:
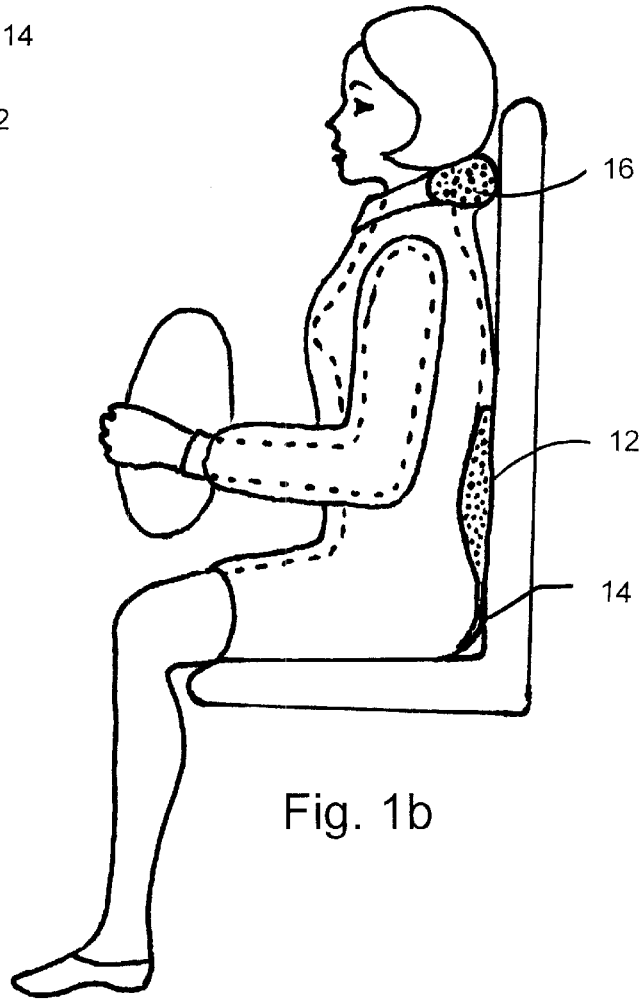
FIG. 1*b* is, in side elevation view, the user of FIG. 1*a* with the inflated capsule in the raised position.

FIG. 1 illustrates a jacket 10 having an inflatable air capsule 12 which may be sewn onto the interior or exterior of the back panel thereof along seam 14 so that it can be folded down and inflated for use as a seat cushion as seen in FIG. 1, or flipped up as seen in FIG. 1*b* and as indicated by dotted line 12' in FIG. 1 to provide an adjustable back support. An inflatable collar capsule 16 may be sewn into or onto collar 18 or jacket 10. A fabric flange 20 sewn to jacket 10 along, for example, seam 22 may be used to support a strip 24 of Velcro™ hook and loop fastener for mating with a corresponding strip (not shown) of Velcro™ on capsule 12.

Figure 2:
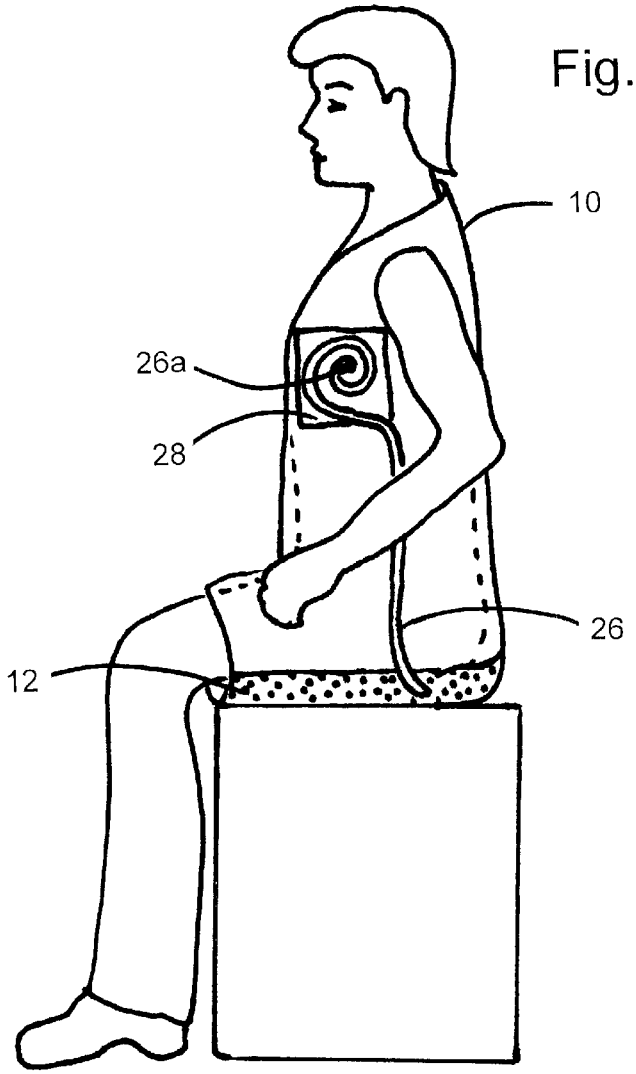
FIG. 2 is, in side elevation view, a user wearing a further alternative embodiment of the inflatable clothing of the present invention, partially cut-away so as to expose an inflation tube, with the inflated air capsule in its lowered position.
Figure 2A:
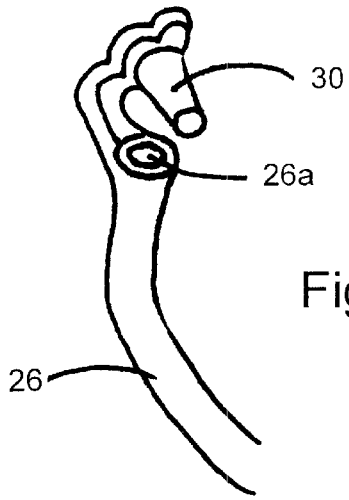
FIG. 2*a* is, in enlarged view, the distal end of the tubing of FIG. 2.

In the embodiment of FIG. 2, flexible tubing 26 is mounted at one end to the air capsule, and extends up a seam of the garment and into, for example, pocket 28. Tubing 26 is sufficiently long so that it may be uncoiled from within the pocket and the opposite end 26*a* of the tube, extended to the user's mouth. Capsule 12 may then be inflated by the user exhaling into the tube. The valve plug 30 is attached to the free end 26*a* of the tubing, as better seen in FIG. 2*a*. To deflate or reduce air pressure, the user pulls the plug out of the tubing. The free end of the tubing is stored, coiled in the pocket, when not in use. This method may be used for capsules located anywhere on articles of clothing so as to correspond to any corresponding areas on the body of the user.

Figure 3A:
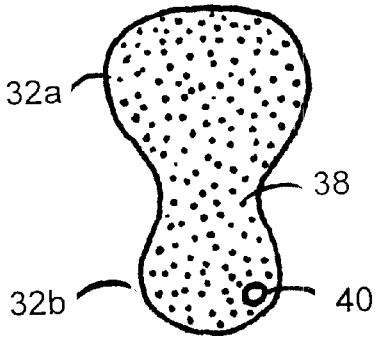
FIG. 3*a* is, in plan view, the front and seat air capsule of the inflatable clothing of FIG. 3.
Figure 3:
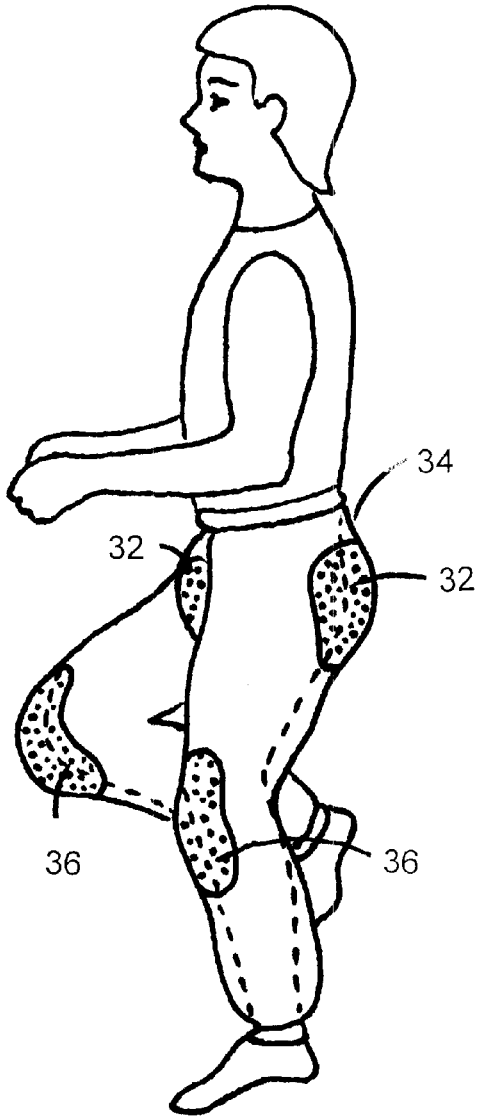
FIG. 3 is, in side elevation view, a user wearing an alternative embodiment of the inflated clothing of the present invention.

For example, FIG. 3 illustrates a crotch and seat air capsule 32 incorporated into pants 34 for bicyclists, horseback riders and motorcyclists on long rides, rough terrain, or during inclement weather. Knee capsules 36 are also illustrated by way of example. As seen in FIG. 3*a*, capsule 32 has a waist 38 for a comfortable fit between the legs of the user. Back and front portions 32*a* and 32*b* are enlarged or flared to provide greater coverage on the user. The valve 40 may be located to the front.

Figure 4:
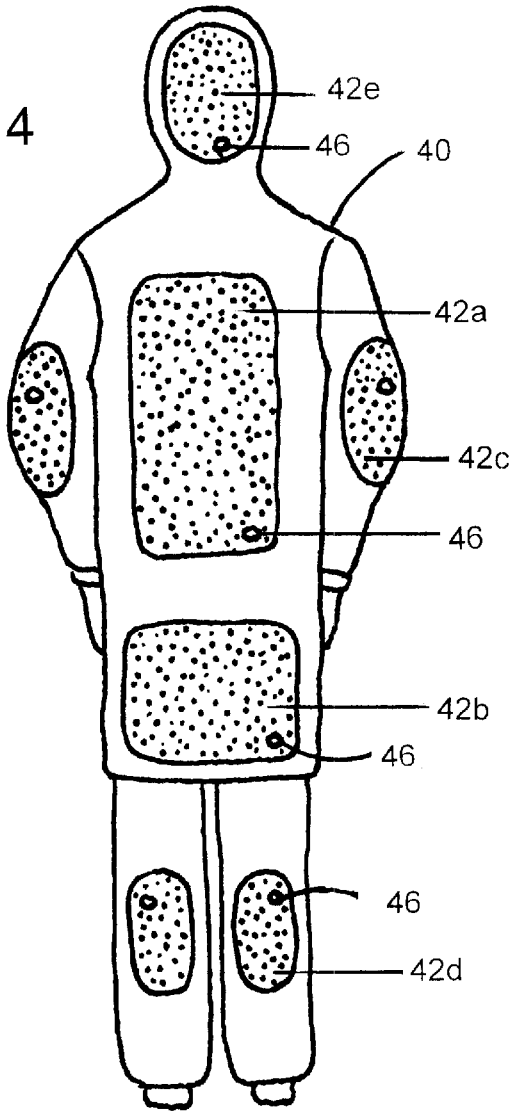
FIG. 4 is, in rear elevation view, a further alternative embodiment of the inflatable clothing of the present invention.
Figure 4A:
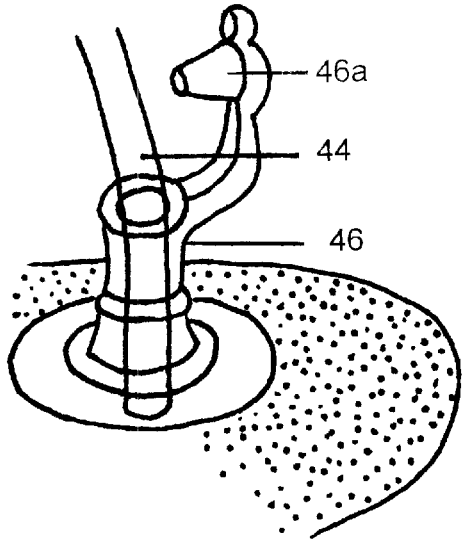
FIG. 4*a* is, in enlarged view, a push-in valve with one end of the tubing of FIG. 2 journalled therethrough for remote inflation and deflation of the air capsules of the present invention.

FIG. 4 illustrates garments or clothing 40 having inflatable back and seat capsules, elbow, knee (not shown) and calf capsules 42*a*, 42*b*, 42*c* and 42*d* respectively and inflatable hood capsule 42*e*. This embodiment is for mechanics or others who work under vehicles or in mud or snow. Capsules 42*a*–42*e* are on the outside of garments 40 to facilitate easy operation of the various inflation options. This may be accomplished by means of a length of flexible tubing 44 such as seen in FIG. 4*a*, the tubing of a diameter so as to slide snugly into push-in valve 46 for convenient inflation by exhalation by the user through tubing 44. The capsules may also be manually inflated by for example a foot, hand, or electric pump or bellows if convenient. Push-in valves 46 may be used on the air capsules of all embodiments of the present invention including capsules 42*a*–42*e*. Push-in valves 46 are sealed by plugs 46*a*.

FIG. 5 illustrates inflatable capsules used in equine clothing. Inflatable hip and back capsules, wither and shoulder capsules, leg wraps and head and neck capsules 48*a*–48*g* respectively are some optional uses of the air capsules. The capsules may be transparent if desired, and may be lined with absorbent material. They may be incorporated into horse blankets and hoods for comfort, warmth and waterproofing while trailering, breeding or whenever indicated. The capsules may be inflated either on or off the horse by means of flexible tubing 44 as shown in FIG. 4*a*, or by a pump or bellows member or any suitable inflation device. As seen in FIGS. 5*a* and 5*b* leg capsule 48*e* may be mounted to the horses leg by wrapping of the bladder around the leg. The air bladder portion 48*e*' of the overall capsule 48*e* surrounds the leg and is releasably fastened thereon for example by strips 50 of hook and loop fasteners mounted on flexible flaps 52.

Figure 6A:
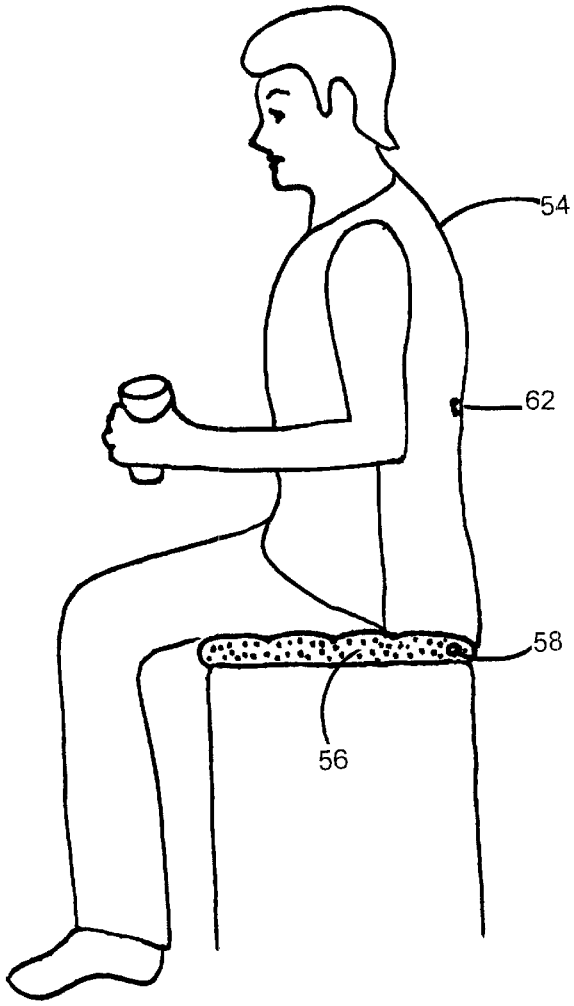
FIG. 6*a* is, in side elevation view, a further alternative embodiment of the present invention with the air capsule inflated and in its lowered position.
Figure 6B:
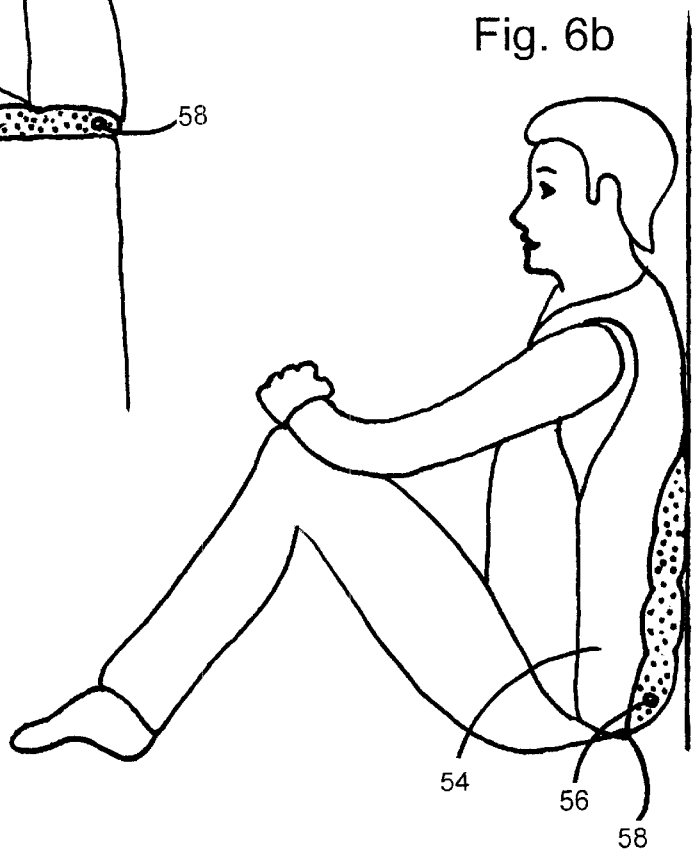
FIG. 6*b* is the inflatable clothing of FIG. 6*a* with the air capsule inflated and in its raised position.
Figure 7A:
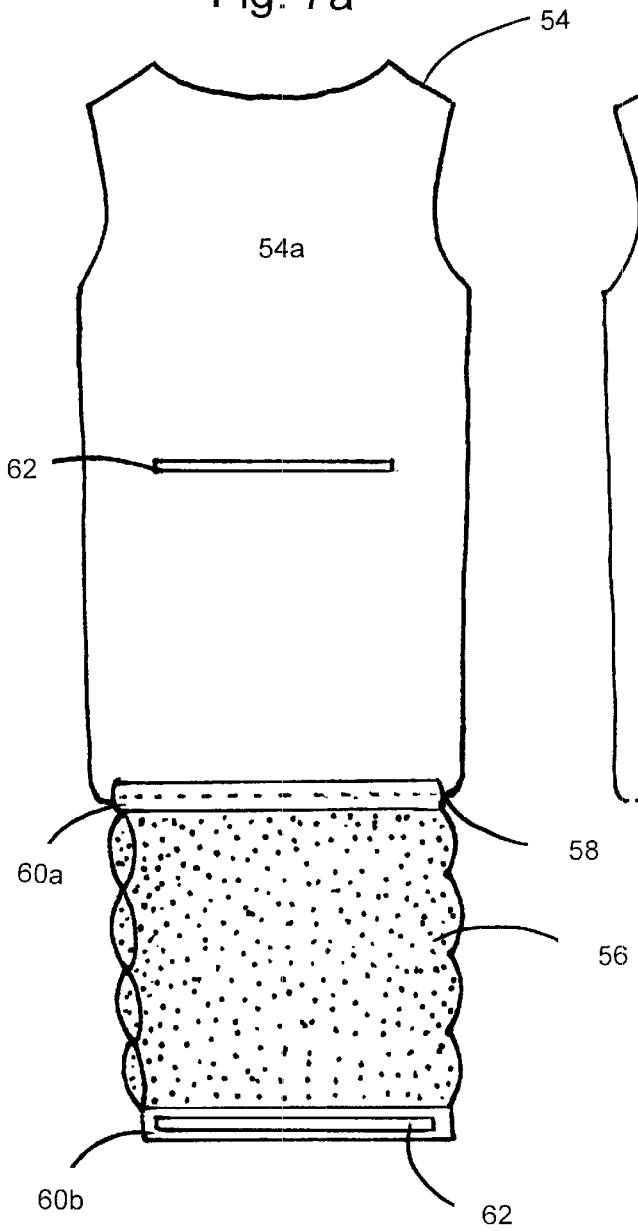
FIG. 7*a* is, in front elevation view, the interior surface of the back panel of the inflated clothing of FIG. 6*a* with the air capsule in its lowered position.
Figure 7B:
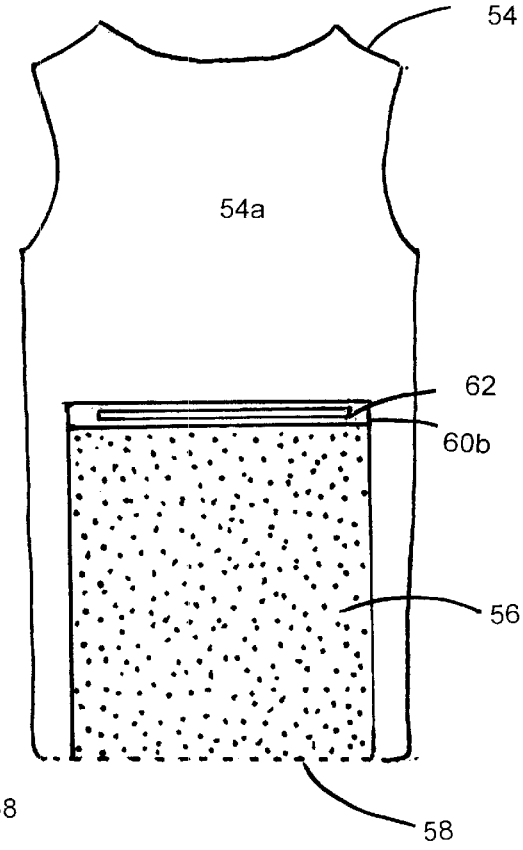
FIG. 7*b* is the view of FIG. 7*a* with the air capsule in its raised position.

FIGS. 6*a* and 6*b* illustrate one embodiment of the present invention in which a vest or jacket 54 has a convertible inflatable seat and back capsule 56 mounted thereto. Inflatable seat capsule 56 is attached at the hemline 58 of the jacket so that the capsule can be used as a seat cushion as in FIG. 6*a* or flipped up as in FIG. 6*b* to become a lumbar support. The vest or jacket may be utilized by outdoor enthusiasts, sports fans, or anyone desiring a soft, comfortable seat or back rest while sitting, or leaning or lying against a hard or cold surface. As better seen in FIGS. 7*a* and 7*b*, the inflatable capsule 56 may be provided with borders of fabric 60*a* and 60*b* at the top and bottom edges respectively. Border 60*a* is sewn into hem 58. The other border 60*b* has a Velcro™ hook and loop fastener strip 62 or other suitable fasteners to hold capsule 56 in place when in the raised position. In the embodiment of employing Velcro™, a corresponding Velcro™ strip is sewn across the back 54*a* of the vest or jacket on the inside of the garment. When deflated, the inflatable capsule 56 lies flat inside the garment, held in place by the fastener. When worn in this manner the inflatable capsule is intended to be relatively inconspicuous.

The vest or jacket 54 can also be taken off by the user, and the inflatable capsule, when inflated, used as a pillow for the user's head when camping or travelling.

In one embodiment, the design of the present invention provides comfort, shock absorption, insulation, support, warmth and waterproofing (or at least water-inhibiting) to the derriere or the lower back, as desired, in an attractive article of clothing. The user's exhaled breath is used to inflate an air capsule by means of the valve such as valve 46. It requires no gas cartridges, wires, straps, tubes (other than as described herein), pouches, straps, hooks, belts, interconnecting chambers or mechanisms. The clothing may, without intending to be limiting, be a vest or jacket, for example, designed for outdoor enthusiasts, the clothing having a built-in inflatable cushion or air capsule. The clothing garment is intended to be easy to put on and take off. It is intended not to be bulky or restrictive when deflated, and relatively lightweight. It is useful to be able to conceal the air capsule in the garment when desired so that it can be worn discreetly thereby allowing it to be incorporated, for example, into fashionable sportswear garments.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. Inflatable clothing comprising a garment having convertible seat and back capsule which includes a manually inflatable air capsule therein, said garment having a back panel and adapted to be worn about at least the torso and midriff of a user, said convertible seat and back capsule pivotally mounted to said back panel along a length of both a hem of said back panel and one edge of said convertible seat and back capsule for pivoting of said convertible seat and back capsule between a raised position, wherein said convertible seat and back capsule is releasably securable by a fastener so as to remain in said raised position and completely hidden within said garment, and a lowered position hanging downwardly from said garment, said convertible seat and back capsule of sufficient size so that, when in said lowered position, said convertible seat and back capsule is adapted to cover the buttocks and upper thighs of the user when the user is wearing said garment, and wherein in said raised position said convertible seat and back capsule provides a back rest for the user and is adapted to support the lumbar region and to extend upwardly up the back or the user to provide a back rest for the user while the user is leaning or lying against a hard surface, wherein said capsule is non-removably mounted to said garment.

2. The inflatable clothing of claim 1 wherein said garment is a jacket.

3. The inflatable clothing of claim 1 wherein said garment is a vest.

4. The inflatable clothing of claim 1 wherein said capsule is mounted to said back panel by a stitched seam extending laterally across said back panel and said upper edge of said capsule.

5. The inflatable clothing of claim 4 wherein said capsule is a generally rectangular flexible bladder.

* * * * *